United States Patent [19]

Mayer

[11] 4,050,269

[45] Sept. 27, 1977

[54] DRY THERMAL TRANSFER OF ORGANIC COMPOUNDS BY NEEDLE-BEARING SUPPORT

[75] Inventor: Fritz Mayer, Haltingen, Germany

[73] Assignee: Ciba-Geigy AG, Basel, Switzerland

[21] Appl. No.: 680,641

[22] Filed: Apr. 27, 1976

Related U.S. Application Data

[62] Division of Ser. No. 571,651, April 25, 1975, Pat. No. 3,986,823.

[30] Foreign Application Priority Data

Apr. 29, 1974 Switzerland ..... 5875/74

[51] Int. Cl.[2] ..... D06B 1/10; D06P 5/15

[52] U.S. Cl. ..... 68/5 D; 28/115; 28/159; 68/204; 81/9.22; 101/470; 118/257; 401/1

[58] Field of Search ..... 101/470; 118/219, 221, 118/255, 202, 257; 68/5 D, 204; 81/9.22; 401/1, 2; 427/248 R, 248 A, 248 B, 248 C, 248 E, 248 H, 248 J; 28/4 R, 4 N, 72, 2 R, 2 F, 74 P, 76 P

[56] References Cited

U.S. PATENT DOCUMENTS

| | | | |
|---|---|---|---|
| 847,578 | 3/1907 | Hudson | 101/148 |
| 987,169 | 3/1911 | Reimann et al. | 401/2 |
| 1,849,407 | 3/1932 | McKee | 101/32 |
| 2,489,640 | 11/1949 | Heller | 118/202 |
| 3,528,367 | 9/1970 | Mumma et al. | 101/425 |
| 3,555,695 | 1/1971 | Dunn | 34/1 |

FOREIGN PATENT DOCUMENTS

| | | | |
|---|---|---|---|
| 1,018,765 | 2/1966 | United Kingdom | 28/74 P |

*Primary Examiner*—Clyde I. Coughenour
*Attorney, Agent, or Firm*—Karl F. Jorda; Edward McC. Roberts; Prabodh I. Almaula

[57] ABSTRACT

This invention provides an apparatus for the dry thermal transfer of organic compounds, preferably of textile finishing agents, onto webs of organic materials, in particular textile webs and carpets, by means of needle-bearing supports. The apparatus comprises means for:

1. applying of a preparation which contains a transferable organic compound to the needle side of the support
2. bringing said needle side of the support into contact with the web, whereby support and web rest against one another,
3. subjecting the support and/or the web to that until the compound has transferred under atmospheric pressure to the web
4. separating the treated textile web from the support.

1 Claim, 4 Drawing Figures

DRY THERMAL TRANSFER OF ORGANIC COMPOUNDS BY NEEDLE-BEARING SUPPORT

This is a adivisional of application Ser. No. 571,651, filed on Apr. 25, 1975, now U.S. Pat. No. 3,986,823 issued Oct. 19, 1976.

The subject of the invention is a process for the dry thermal transfer of organic compounds onto webs of organic material, characterised in that a support consisting of metal needles mounted perpendicularly to a substrate is used and 1. preparations which contain at least one organic compound which passes into the vapour state under atmospheric pressure above 80° C are applied to the needle side,
2. the needle side of the support is brought into contact with the web of organic material so that the support and the web rest against one another and, if required, travel together,
3. the support and/or the web are exposed to heat for at least the time required to transfer the said compound to the web and
4. the treated web is separated from the support.

Sublimable disperse dyestuffs and sublimable chemicals should above all be mentioned as compounds which pass into the vapour state under atmospheric pressure above 80° C, especially at 100° to 220° C or above all 180° to 220° C.

The support required for the process according to the invention is preferably endless but can also match the textile webs of organic material to be treated, that is to say can also be cut into shorter or longer pieces. Suitably, it is an endless belt which is fitted with needles and which, if required, travels continuously and synchronously with the textile web. The needle bed, that is to say the actual travelling support fitted with needles, consists of a great diversity of materials, especially of metal fibres, textile fibres or plastic. As a rule, the support is inert, that is to say it has no affinity to the preparations which contain the compound to be transferred.

Advantageous supports are, for example, metal fibre fleeces or felts which are reinforced with polyester, glass or ceramic fabrics or some other heat-resistant fibre. Layers of metal fibres or, for example, also layers of aluminium foil improve the heat conductivity of the needles mounted thereon and as a result reduce the temperature gradient between the needle points and the needle bed.

The needles are, for example, metal wires which have a diameter of 0.1 to 3 mm. The length of these needles can also vary greatly and can be, for example, 1 to 20 mm, preferably 2 to 10, mm.

The thickness or diameter of the needles depends on the cover density. The cover density can be between 10 and 200 needles per $cm^2$. At lower cover densities, for example 30 to 50 needles per $cm^2$, the wire diameter can be 1 to 3, preferably 2, mm. At higher cover densities, for example 100 to 200 needles per $cm^2$, the wire thickness can be reduced from 1 mm down to 0.3 mm. The thinner wires are protected against bending by the higher cover density.

When using as many thin needles as possible per unit area, the organic compound to be transferred only has to overcome small distances from the needle to the receiving textile web, for example only 0.2 mm in the case of a cover density of 200 and a wire diameter of 0.3 mm. When transferring dyestuffs, these conditions in each case give a uniformly dyed surface.

When using thicker wires of, for example, 1 to 3 mm or above, pattern effects, such as those obtained by the pointillisme technique of painting.

The needles or wires may have round, triangular, square or hexagonal cross-sections; they may in addition be provided with recesses, cut-out portions and the like.

The metal needles are preferably needles of a metal of good conductivity, such as iron, copper or, above all, steel needles.

The preparations which can be used in accordance with the process can contain, in addition to the compounds which transfer to the textile web, at least one binder which is stable below 250° C, water and/or an organic solvent.

Suitable binders are synthetic, semi-synthetic and natural resins, including both polycondensation products and polyaddition products. In principle, all binders customary in the paint industry and printing ink industry can be used. The binders serve to hold the compounds, which are to be transferred, on the treated area of the support. However, at the transfer temperature the binders should not melt, should not react with themselves, for example crosslink, and should be able to release the compound which is to be transferred. Binders which dry rapidly, for example in a warm stream of air, and form a fine, preferably non-tacky film on the support, are preferred.

The following may be mentioned as examples of suitable water-soluble binders: alginate, tragacanth, carubin (from carob bean flour), dextrin, etherified or esterified plant mucilages, carboxymethylcellulose or polyacrylamide; amongst binders soluble in organic solvents there may be mentioned cellulose esters, such as nitrocellulose or cellulose acetate, and especially cellulose ethers, such as methylcellulose, ethylcellulose, propylcellulose, isopropylcellulose, benzylcellulose or hydroxyethylcellulose, as well as their mixtures. Amongst these, ethylcellulose is of outstanding importance.

Preferably, however, the process is carried out without any added binder.

As organic solvents it is possible to use watermiscible or water-immiscible organic solvents or solvent mixtures of boiling point below 150° C, preferably below 120° C, under normal pressure.

It is advantageous to use aliphatic, cycloaliphatic or aromatic hydrocarbons, such as toluene, cyclohexane or petroleum ether, lower alkanols such as methanol, ethanol, propanol and isopropanol, esters of aliphatic monocarboxylic acids, such as ethyl acetate or propyl acetate, aliphatic ketones, such as methyl ethyl ketone and halogenated aliphatic hydrocarbons, such as perchloroethylene, trichloroethylene, 1,1,1-trichloroethane or 1,1,2-trichloro-2,2,1-trifluoroethylene. Particularly preferred solvents are lower aliphatic esters, ketones or alcohols, such as butyl acetate, acetone, methyl ethyl ketone, ethanol, isopropanol or butanol, as well as their mixtures, for example a mixture of methyl ethyl ketone and ethanol in the ratio of 1 : 1. Ethanol, methyl ethyl ketone and the 1:1 ethanol:methyl ethyl ketone mixture are particularly preferred. The pastes can then be adjusted to the desired viscosity by adding the binders mentioned together with a suitable solvent.

However, it is also possible to apply the compound which is to be transferred, especially chemicals which are to be transferred, by themselves, that is to say without solvent and binder, to the inert support.

The weight ratio of the individual components in the preparation used to pretreat the metal needles can vary greatly and is, for example, between 0.1 and 100% by weight of the compounds to be transferred to the fibre material, between 0 and 30% by weight of the binder and between 0 and 99.9% by weight of the solvent of solvent mixture, based on the total weight of the preparation.

1 to 100 g, preferably 15 to 40 g, of the compound to be transferred to the fibre material may be applied, per $m^2$ of support, to the needle-bearing belt.

The preparations which can be used according to the invention are produced, for example, by dissolving the compound, which is transferred to the fibre material under atmospheric pressure, above 80° C in water and/or organic solvents, or finely dispersing it therein, if appropriate in the presence of a binder which is stable below 250° C. It is also possible to apply organic compounds, especially chemicals, in the pure state, that is to say directly as such, by sprinkling, spraying or pouring.

The organic compound to be transferred is applied by brushing or coating the needle bed, or, if the support is travelling, preferably not directly onto the needlebearing belt but via brushes. The fineness of the bristles may, in the latter case, be varied. The brushes rotate more or less rapidly and take up the dyestuff or the chemical from a padding roller which in turn dips into the dyestuff preparation or chemical preparation.

The speed of rotation can be varied in accordance with the amount which it is desired to apply. With this type of application, the needle points and needle base are provided with different concentrations of the compound to be transferred. This, together with the speed at which the needles are inserted into the pile and the degree to which the needles are warmed has the effect that during the insertion of the needles (into the pile) light-dark gradients are produced, in the case of dyestuffs, both from the base of the pile to the top of the pile and vice versa.

In order that no crusts should form on the needlebearing belt, the dyestuff preparation or preparation of chemicals should as far as possible be free from products which form crusts and do not vaporise or do not sublime. If only a part of the needles, for example within a defined area (pattern) is to be provided with dyestuff or chemicals, a roller covered with abrasion-resistant foam rubber or some other porous material is used, in place of the brushes, for applying the dyestuff to the needles. This porous roller covering is in turn printed with the dyestuff or chemicals by means of a rotating screen.

In the case of light colorations, the patterned application of dyestuff to the porous source material can also be effected by means of known printing techniques, such as by means of an engraved roller and doctor blade, or by gravure printing.

If the support and the goods are travelling, the path of the needle-bearing belt and of the goods is advantageously so arranged, by means of guide rollers, that the needles gradually penetrate into the pile and up to the base fabric and are equally gradually withdrawn again. As a result, the pile is neither roughened nor deformed or otherwise damaged.

If the pile contains metal wires, they are heated, from the side to which they are anchored to 180° - 220° C by hot air or infra-red radiators or, best of all, in accordance with the principle of inductive heating of metal. The needles are allowed to remain in the pile for 10 to 100 seconds. In the case of supports and goods which travel conjointly and synchronously, this residence time is ensured by using a speed of the support and of the goods of from 1 to 30 m/min. During this time, the metal wires transfer the organic compound to the surrounding fibres. The needles can also be brought to an elevated temperature even before they enter the pile, or be introduced into the pile with some delay. This ensures greater transfer of the organic compounds to the pile tips than the pile base.

Before the insertion of the needles which carry the compound which is to be transferred, the pile of the textile web is warmed by means of, for example, infrared rays or hot air, as nearly as possible to the transfer temperature of the organic compound. This measure prevents excessive cooling of the needles and again reduces the temperature difference between the needle base and the needle point.

Where application is effected with rollers having a porous surface, the needles of the travelling support jab into the porous surface and take up the requisite amount of the compound which is to be transferred.

In areas in which no transfer is to take place, the needles enter the roller covering which is not provided with an organic compound, that is to say the clean roller covering. Thereafter the needles are dried, for example by means of hot air or infra-red radiators. If, for example, a carpet is to be dyed in a single colour, it is not necessary for the dyestuff to vaporise or sublime quantitatively from the needle; it is merely necessary to supplement with a constant amount. Where the organic compound is to be transferred in a pattern onto the web, it is desirable to vaporise this compound as quantitatively as possible so as to produce clean patterns.

At times it is advantageous to clean the needles after the application process. This cleaning can be effected, for example, by briefly overheating the needles at a point remote from the textile web, or by treating the needles with round brushes containing solvent.

In order completely to fix the compound which has been transferred and to level out any unevennesses, it can be advantageous to heat the textile web or its pile before, during or after the transfer of the compound.

It is also possible to install several colour applicators or chemicals applicators on one needle-bearing belt or to allow several needle-bearing belts successively to engage with the pile of the textile web in order to dye it, or finish it, in patterns or evenly.

A further embodiment is one wherein the needles are embedded in small sheet-like units, for example in rectangles of size 10 cm × 30 cm, and these so-called needle units can be assembled, or strung together, with known conveying systems, to give any desired surface. In this way, a continuously moving textile web can be dyed or finished by means of a continuously formed needle-bearing belt. The dyestuff or chemicals is or are applied as indicated earlier, either to the individual elements or to the endless belt when already formed. Here again the needles are advantageously heated by induction.

The individual elements are conveyed by means of travelling belts or chains. They form a continuous or interrupted belt only on the continuously moving textile which is to be treated. Once they have transferred the dyestuff or the chemicals to the textile web, they are immediately returned to the applicator so that they can be recharged (with dyestuff or chemicals) and then reintroduced into the process. As has already been mentioned before, the heat treatment or the heat transfer take place at temperatures of at least 80° C and preferably 100° to 220° C. Temperatures of 180° to 220° C are very particularly preferred.

The process according to the invention has the advantage that, above all, bulky forms of presentation of textile webs can thereby be treated successfully with dyestuffs or chemicals in accordance with the heat-transfer process. Thus the process according to the invention is above all suitable for the treatment of carpets or velvet furnishing fabrics and similar bulky textile materials. In each case, thick materials such as velvet or carpets, especially velvet furnishing fabrics or pile carpets, are concerned.

The fibre materials can have been dyed or finished by conventional methods before the treatment in accordance with the process of the invention. The fibre material itself can consist of natural fibres or, above all, synthetic fibres. Natural fibres to be mentioned are especially those of wool and cellulose, such as cotton, linen, hemp or ramie. As synthetic fibre material which can be treated in accordance with the invention, there should be mentioned cellulose ester fibres such as cellulose 2½-acetate and triacetate fibres, synthetic polyamide fibres, for example those of poly-ε-caprolactam (nylon 6), polyhexamethylenediamine adipate (nylon 6,6), poly-ω-aminoundecanoic acid (nylon II), polyuerthane fibres or polyolefine fibres, for example polypropylene fibres, acid-modified polyamides such as polycondensation products of 4,4'-diamino-2,2'-diphenyldisulphonic acid or 4,4'-diamino-2,2'-diphenylalkanedisulphonic acids with polyamide-forming starting materials, polycondensation products of monoaminocarboxylic acids or their amide-forming derivatives or dibasic carboxylic acids and diamines with aromatic dicarboxysulphonic acids, for example polycondensation products of ε-caprolactam or hexamethylenediammionium adipate with potassium 3,5-dicarboxybenzenesulphonate, or acid-modified polyester fibres, such as polycondensation products of aromatic polycarboxylic acids, for example terephthalic acid or isophthalic acid, polyhydric alcohols, for example ethylene glycol, and 1,2- or 1,3-dihydroxy-3-(3-sodium sulphopropoxy)-propane, 2,3-dimethylol-1-(3-sodium sulphopropoxy)-butane, 2,2-bis-(3-sodium sulphopropoxyphenyl)-propane or 3,5-dicarbo xybenzenesulphonic acid or sulphonated terephthalic acid, sulphonated 4-methoxybenzenecarboxylic acid or sulphonated diphenyl-4,4-dicarboxylic acid.

Preferably, however, the process is applied to fibre materials of polyacrylonitrile or acrylonitrile copolymers and above all linear polyester fibres or polyamide fibres. The polyester fibres are, in particular, linear polyester fibres of poly(ethylene glycol terephthalate) of poly-(1,4-cyclohexanedimethylol-terephthalate).

Where acrylonitrile copolymers are concerned, the proportion of acrylonitrile is suitably at least 50% and preferably at least 85% of the copolymer. The comomomers used are normally other vinyl compounds, for example vinylidene chloride, vinylidene cyanide, vinyl chloride, methacrylates, methylvinylpyridine, N-vinylpyrrolidone, vinyl acetate, vinyl alcohol, acrylamide or styrenesulphonic acids.

These fibre materials can also be used as mixed fabrics in which they are mixed with one another or with other fibres, for example mixtures of polyacrylonitrile and polyester, polyamide and polyester, polyester and viscose, polyester and wool or polyester and cotton.

The chemicals usable according to the invention, which are transferred to the textile web, are to be understood to include, for example, optical brighteners and above all textile treatment agents. These include so-called pretreatment agents, textile finishing agents and textile protection agents.

The sublimable disperse dyestuffs which can be used according to the invention and which are transferred to the textile web can belong to a great variety of categories of dyestuff. In particular, monoazo, quinophthalone, methine and anthraquinone dyestuffs, as well as nitro, styryl, azostyryl, naphthoquinone or naphthoquinone-imine dyestuffs are concerned.

The commercially available forms of these dyestuffs in general contain dispersing agents, that is to say a product having surface-active properties, which permits, or facilitates, dispersing these dyestuffs in water. The presence of dispersing agents is not necessary when using anhydrous preparations.

Examples of sublimable disperse dyestuffs which can be used according to the invention are:

(1)

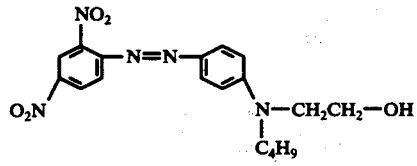

(2)

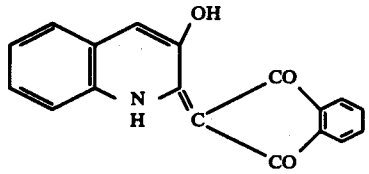

(3)

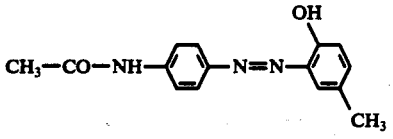

(4)

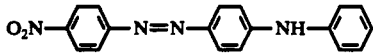

(5)

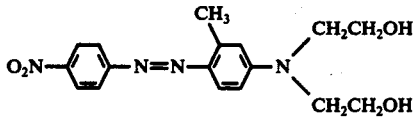

(6)

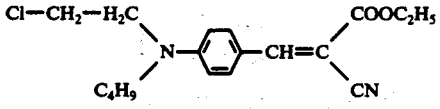

(7)

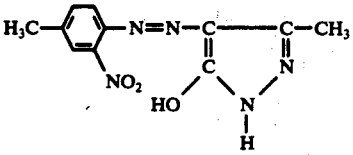

-continued
(8)
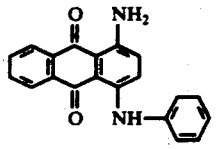
(9)
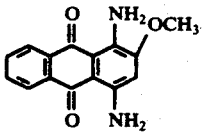
(10)
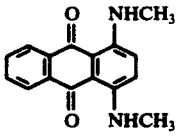
(11)
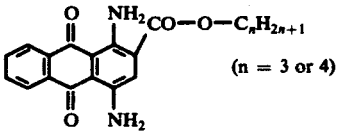
(n = 3 or 4)
(12)
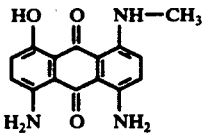
(13)
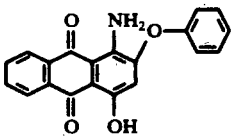
(14)
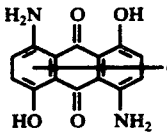
(n = 1 or 2)
(15)
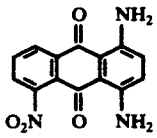
(16)
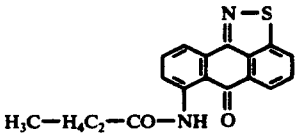
(17)
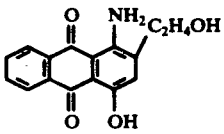
-continued
(18)
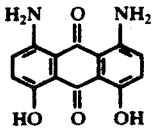
(19)
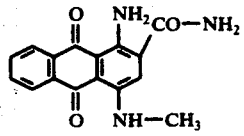
(20)
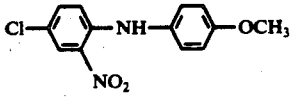
(21)
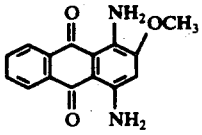
(22)
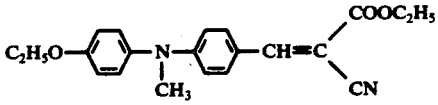
(23)
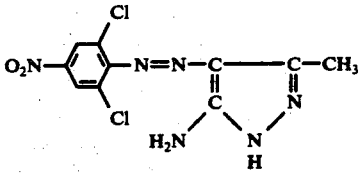
(24)
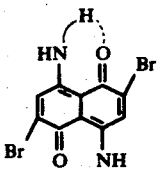
H
(25)
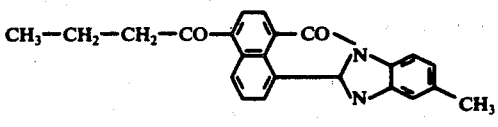
(26)
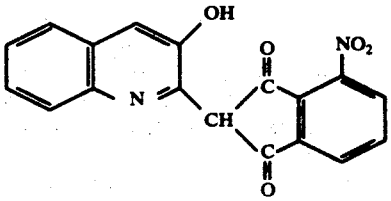

-continued (27)

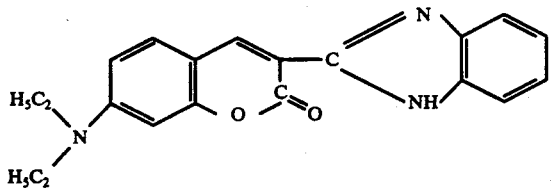

The sublimable optical brighteners can belong to any desired categories of brighteners. In particular, they are coumarins, benzocoumarins, pyrazines, pyrazolines, oxazines, oxazoyl compounds, thiazolyl compounds, dibenzoxazolyl compounds or dibenzimidazolyl compounds, as well as napththalic acid imides. Examples of sublimable optical brighteners which can be used according to the invention are:

(28)

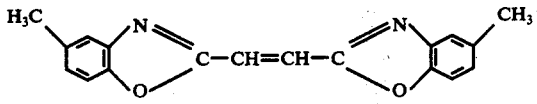

(29)

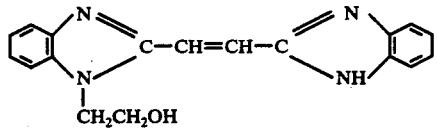

(30)

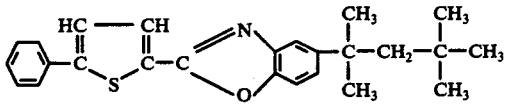

(31)

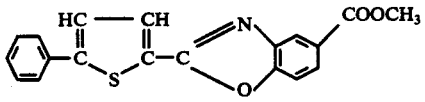

(32)

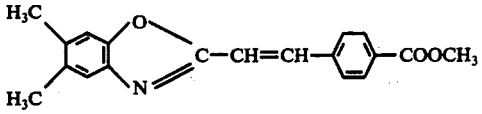

(33)

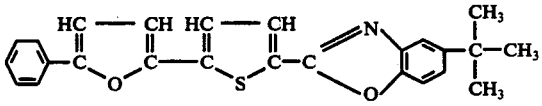

(34)

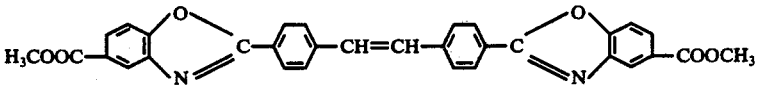

(35)

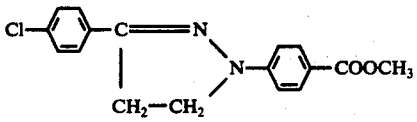

(36)

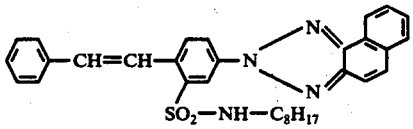

(37)

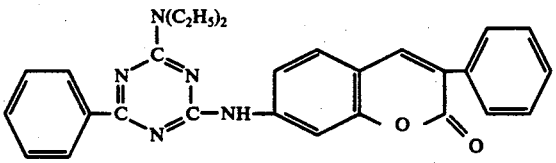

-continued (38)

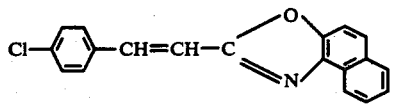

(39)

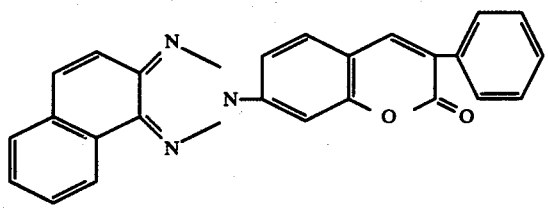

(40)

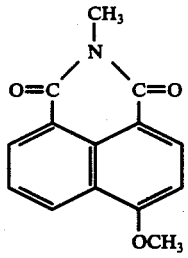

(41)

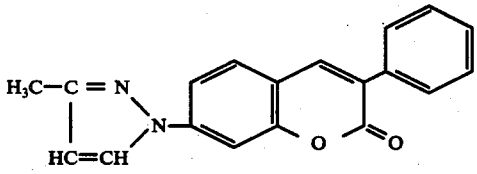

(42)

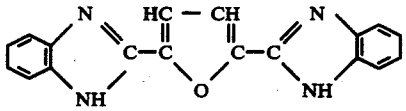

(43)

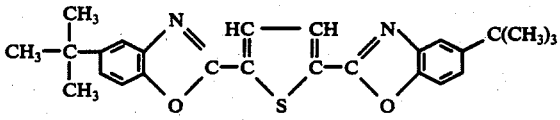

(44)

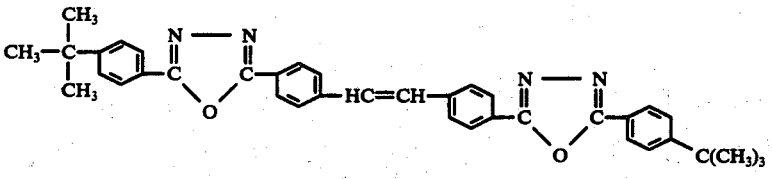

As chemicals which are transferred onto the organic material under atmospheric pressure at above 80° C there should above all be mentioned textile finishing agents, such as softeners and textile protection agents. Examples of possible textile protection agents are protection agents which, for example, impart bacteriostatic and/or fungistatic and/or fungicidal properties or antistatic, oil-repellent and water-repellent or flameproof effects, to the textile material. The said textile protection agents and/or finishing agents can, if desired, be applied to the material to be finished conjointly with dyestuffs and/or optical brighteners which pass into the vapour state under atmospheric pressure at, for example, between 150° and 220° C.

The chemicals which can be used according to the invention are in part known, or can be prepared according to methods which are in themselves known. They belong to a great variety of categories.

The compound of the formula (45)

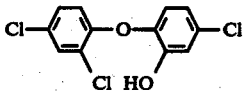

may be mentioned as an example of a bacteriostatic protection agent and the compound of the formula (46)

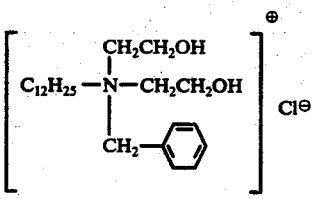

and the compound of the formula (47)

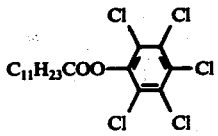

may be mentioned as examples of a fungistatic protection agent.

The compound of the formula (48)

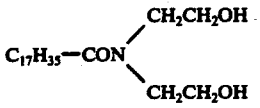

may be mentioned as an example of compounds which impart handle-improving properties to the textile fabric, and the compound of the formulae (49)

$HO-(CH_2CH_2O)_{7-15}H$ (50)

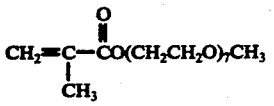

(51)

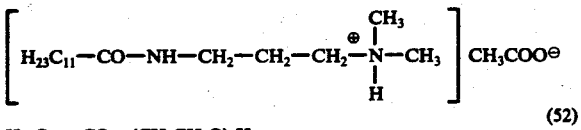

(52)

$H_{23}C_{11}-CO-(CH_2CH_2O)_7H$ (53)

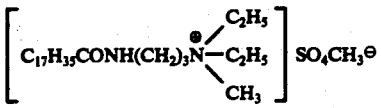

(54)

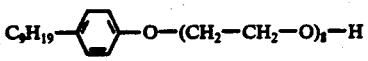

(55)

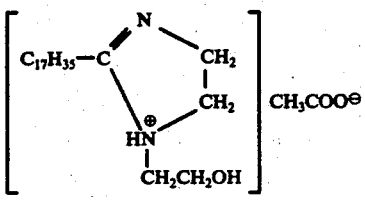

(56)

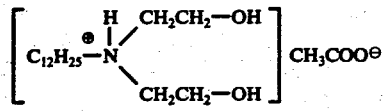

as well as a condensation product of 1 mol of diethylenetriamine, 2 mols of stearic acid and 1 mol of acrylonitrile, or a condensation product of 2 mols of stearic acid N-methylolamide and 1 mol of triethanolamine, quaternised with benzyl chloride, may be mentioned as examples of compounds which impart antistatic properties to the fabric.

The compounds of the formulae (57)

$C_{17}H_{35}NCO$

-continued (58)

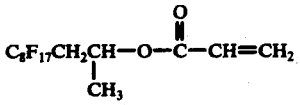

(59)

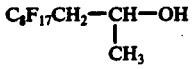

(60)

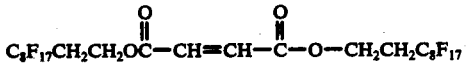

(61)

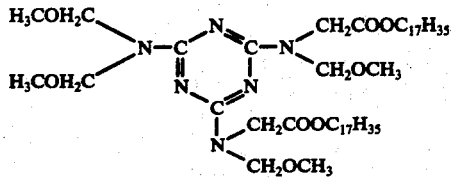

or hydrogenomethylpolysiloxanes or dimethylhydrogenopolysiloxanes may be mentioned as examples of compounds which impart water-repellent properties to the textile material.

In addition to the water-repellent properties, the compound of the formula (59) can also impart oil-repellent properties to the textile material and the compound of the formula (61) can also impart anti-soiling properties.

Examples of possible flameproofing agents are the following compounds:

A. Methylenedioxybenzene compounds of the formula (62)

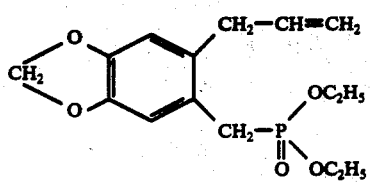

(63)

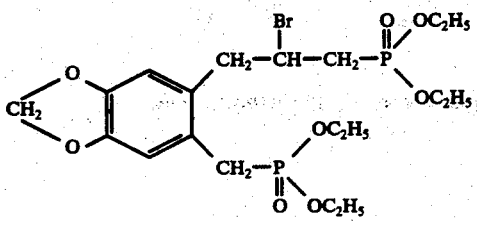

(64)

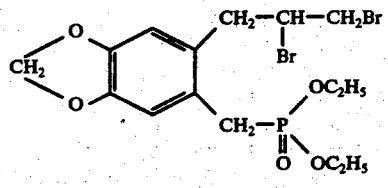

(65)

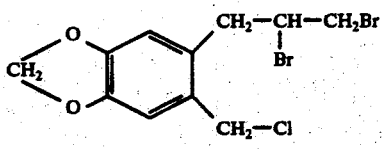

B. Phosphorus compounds of the formulae

-continued
(66)
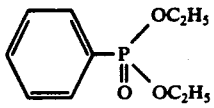
(67)
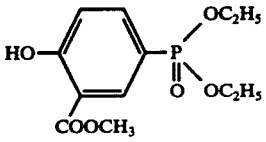
(68)
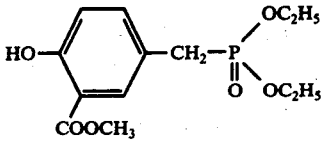
(69)
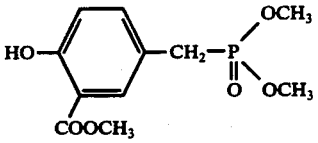
(70)
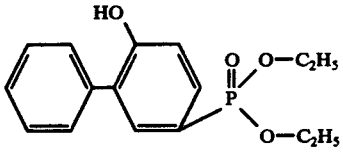
(71)
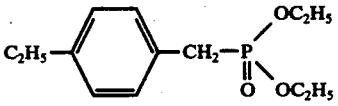
(72)
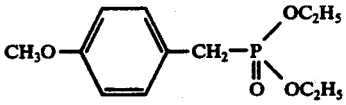
(73)
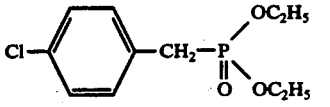
C. Phosphorus compound of the formalae
(74)
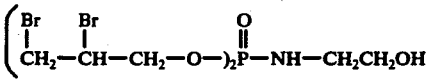
(75)
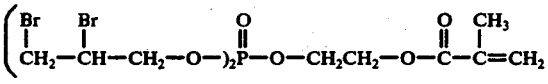
(76)
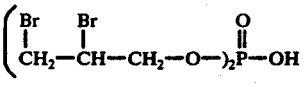
(77)
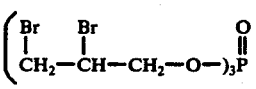
D. Halogen compounds of the formulae
(78)
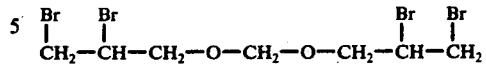
(79)
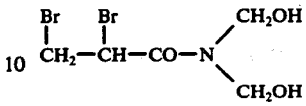
(80)
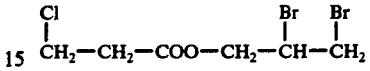
(81)
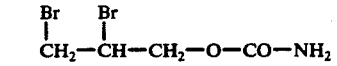
(82)
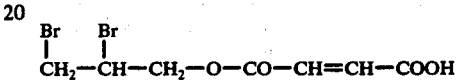
(83)
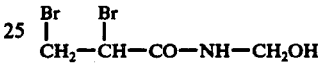
(84)
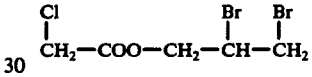
(85)
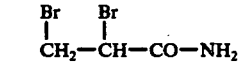
E. Halogen compounds of the formulae
(86)
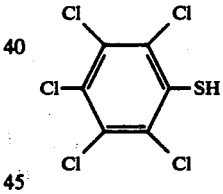
(87)
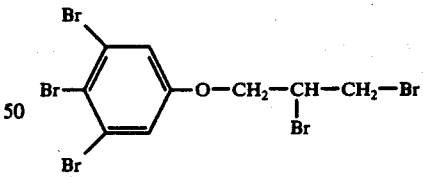
(88)
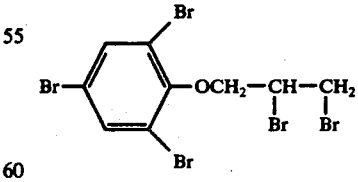
(89)
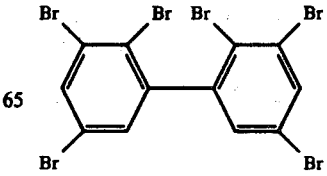

-continued (90)

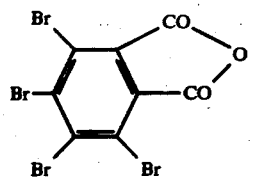

(91)

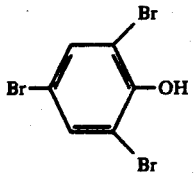

(92)

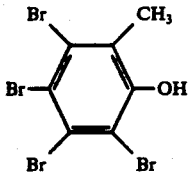

In choosing the textile finishing agent or agents, one takes into account, on the one hand, the desired effects, and, on the other, the temperature at which these compounds transfer, without decomposition, onto the organic material. Preferred compounds are those which have transfer temperatures between 100° and 220° C, especially 150° to 200° C. To achieve several finishing effects in a single process step, it is preferred to use textile finishing agents having transfer properties which are as similar as possible, that is to say agents which have similar transfer temperatures, which do not differ by more than 20° C.

A further subject of the invention is an apparatus for carrying out the stated dry transfer process. This apparatus is characterised by:

a. A web-like support which can be moved in a longitudinal direction and which has metal needles mounted vertically thereon,
b. means for applying organic compounds to the support, followed, in the direction of travel, by
c. a device which feeds the textile web of organic material, which is to be treated, to the charged support,
d. means for heating the needles of the support,
e. if appropriate, means for warming the textile web and
f. means for removing the treated textile web of organic material from the support; in this apparatus, along a certain zone which, in the direction of travel, follows the applicator, the needle side of the support, provided with the material applied, faces the textile web and is kept in contact therewith, and the support and textile web travel synchronously and conjointly pass the means of warming, and after the organic compound has been transferred from the support to the textile web, the textile web and the support are separated from one another.

Figure 1:
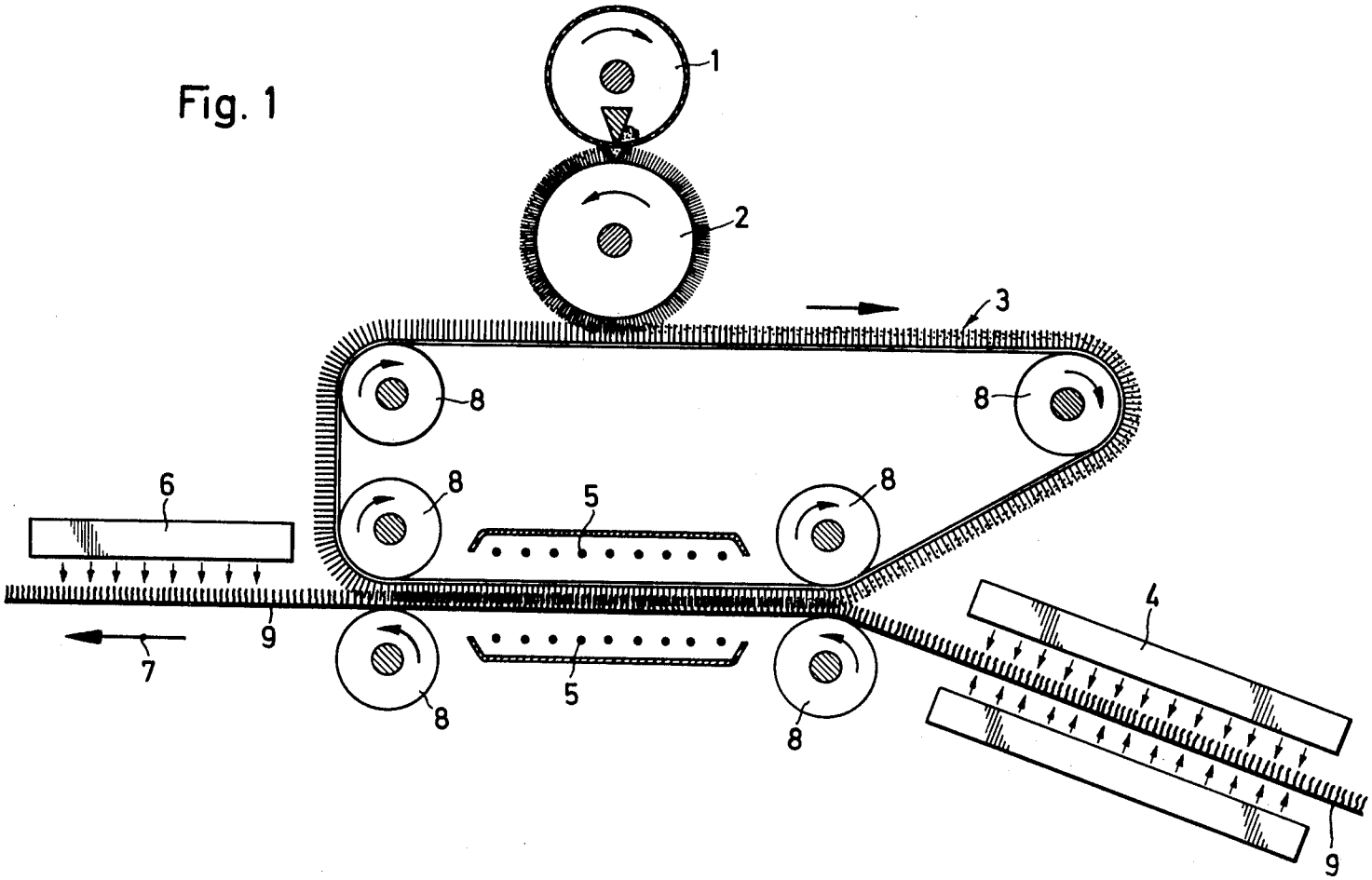
FIG. 1 is a preferred embodiment.

A preferred embodiment of the apparatus accoding to the invention is depicted in FIG. 1, the textile web 9 is preheated in the heating apparatus 4, for example an infra-red radiator. The rotary screen 1 applies, for example, a dyestuff to the brush 2, and this in turn transfers the dyestuff onto the needle-bearing belt 3; the needle-bearing belt travels in a clockwise direction, comes into contact with the textile web 9, for example a carpet, between the rollers 8 and is warmed to the transfer temperature by means of the heating means 5, which consists, for example, of an induction heating coil. 7 indicates the direction of travel of the textile web 9. The heating apparatus 6 ensures that the dyestuff is fixed.

A further subject of the present invention is a support for the dry heat transfer of organic compounds onto textile webs of organic material, characterised in that it is webshaped and carries metal needles mounted vertically thereon.

Figure 2A:
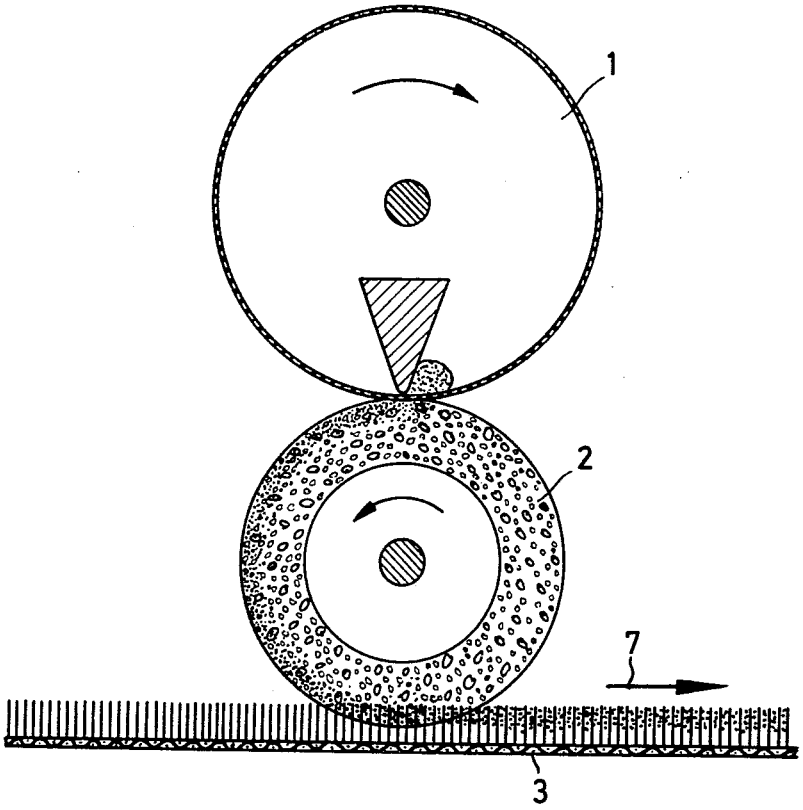
FIGS. 2A, 2B and 2C show applicator apparatus of a thermal transfer apparatus.

FIG. 2A —Application in certain areas (print)

Figure 2B:
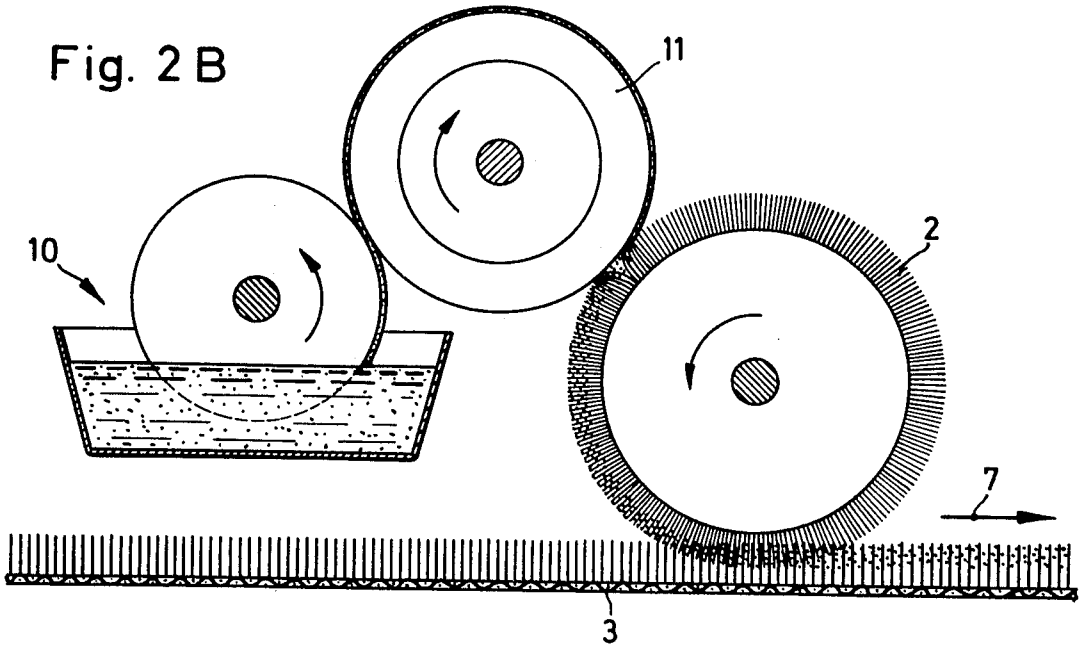

1 Rotary screen
2 Soft, porous material into which the needles are inserted in order to take up the organic compound (sponge, felt or brushes)
3 Needle-bearing belt
7 Direction of travel FIG. 2B—Application over the entire area (uniform effect)

Figure 2C:
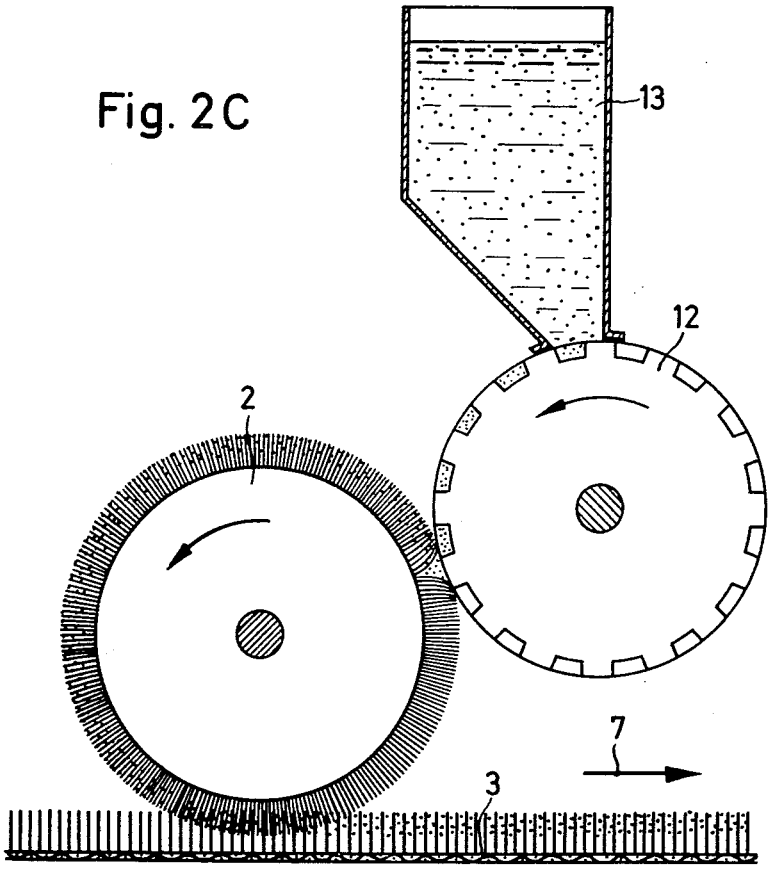

11 Transfer roller
2 Brush
3 Needle-bearing belt
10 Padding unit
7 Direction of travel FIG. 2C—Application over the entire area, for powders and pastes 13 Powders or pastes
12 Metering roller with recesses
3 Needle-bearing belt
2 Transfer brush
7 Direction of travel The percentages in the preparation instructions and examples which follow are percentages by weight.

Preparation instructions for dyestuff inks

A. 40 g of the yellow disperse dyestuff of the formula (2) are ground with 100 g of ethylcellulose in 860 g of a 1:1 methyl ethyl ketone/ethanol mixture for 5 hours at 20° C in a sand mill, and dispersed to form a homogeneous ink.

B. If,instead of the yellow disperse dyestuff, 40 g of the red disperse dyestuff of the formula (13) are used and in other respects the procedure indicated under A is followed, a corresponding red ink is obtained.

C. If,instead of the yellow disperse dyestuff, 40 g of the blue disperse dyestuff of the formula (10) are used and in other respects the procedure indicated under A is followed, a corresponding blue ink is obtained

EXAMPLE 1

A b 3.75% stength dyestuff ink according to instruction A is applied by means of a paintbrush to a plate carrying stainless steel needles. The solvent evaporates at room temperature. The amount of ink applied is 10% of the carpet pile weight to be dyed (600 g/m², 5 mm thick pile). The needles project 10 mm from their felt bed. There are approx. 40 needles per square centimetre. The needle-bearing plate, of size 5 cm × 20 cm, is stuck into a piece of polyamide 6,6 tufted carpet of exactly the same size, after preheating the needle-bearing plate for 5 minutes between two metal phases, heated to 200° C. The piece of carpet was preheated under an infra-red lamp in order to reduce the temperature drop of the metal needles as much as possible. The needle-bearing plate remains stuck in the polyamide carpet for 2 minutes; during this time heat is applied simultaneusly from the back of the needle-bearing plate and from the back of the carpet by means of heating plates, at 200° C, pressed lightly against them. The yellow dyestuff applied to the needles is transferred in the course of these 2 minutes to the surrounding carpet fibres, penetrates into the fibres and gives a yellow carpet dyed uniformly from the base of the pile to the tip of the pile.

EXAMPLE 2

The same amount of the red ink according to instruction B is applied to the needles in the same way as in Example 1. The needle-bearing plate is then stuck into a polyester cut pile carpet (6 mm pile height, 850 g of pile fibres/m²). The carpet and the needle-bearing plate have beforehand been preheated as in Example 1. The transfer process is again carried out for 2 minutes at 200° C. Thereafter, the polyester cut pile carpet is found to exhibit a medium red dyeing from the base to the pile tips.

EXAMPLE 3

The inks A, B and C, each as 3.75% strength inks as in Example 1, are applied to the needle-bearing plate, spatially, cleanly separated from one another, but in such a way that the applied amounts of inks A, B and C are 60% of the carpet pile weight; the inks are transferred to the polyamide-6,6 tufted carpet as described in Example 1. Sharp lines of separation between the individual dyestuff areas are produced, so that a patterned dyeing of the carpet is achieved.

EXAMPLE 4

The dyestuff inks mentioned in Example 3 are applied by means of a paintbrush, separately and superposed in certain patterns, to the needes. The amounts of inks are in total greater than in Examples 1 to 3. In the present example they are 50% of the carpet pile weight to be dyed and, in the superposed part of the pattern, in particular 30% of the carpet pile weight. The transfer is carried out in the same way as in Examples 1 to 3, onto the polyamide-6,6 carpet mentioned.

The colours known from the laws of additive colour mixing, with their corresponding gradations, are produced, for example orange between red and yellow, green between yellow and blue, violet between red and blue and the like.

EXAMPLE 5

50 g of the compound of the formula (61) are dissolved in 50 ml of ethanol and 0.6 g of this solution are brushed onto a needle-bearing plate of size 10 cm × 10 cm, carrying, per cm², 25 needles which project 8 mm from their cotton cloth bed, so that the needles carry 5% of the above compound, relative to the weight of the carpet fibres. The solvent dries off very rapidly at room temperature. The needle support prepared in this way is pressed into a polyamide-6,6 or polyester carpet pile (600 g/m², 5 mm pile height) and the carpet and needle support are heated for 3 minutes between two metal plates heated to 200° C. Thereafter the needle plate is again taken out of the pile.

Pieces of carpet which are treated in this way take up less dry dirt than the untreated pieces, that is to say they show an anti-soiling effect. In addition, spilt red wine or fruit juice only seeps into the carpet after about 5 minutes, so that there remains plenty of time to remove the staining liquid before it penetrates into the carpet. This produces a marked protection against staining. Carpets which are untreated or have only been superficially treated immediately absorb spilt liquid.

EXAMPLE 6

50 g of a condensation product of 1 mol of diethylenetriamine, 2 mols of stearic acid and 1 mol of acrylonitrile are dissolved in 50 ml of methyl ethyl ketone. 0.4 g of this concentrated solution are brushed onto a 10 cm × 10 cm piece of the needle support which has 30 needles per cm², projecting 8 mm from their steel fibre fleece bed. The solvent dries off at room temperature. The needles pretreated in this way are stuck into the carpets to be treated and heated for 3 minutes between metal plates heated to 200° C.

The following values of the electrostatic charge are found for the untreated and treated carpets:

| | Friction Partner | Un-treated | Treated |
|---|---|---|---|
| Polyamide-6,6 carpet (600 g/m², 5 mm pile height) | Leather | 1,000 volt | 0 volt |
| Polyester cut pile carpet (600 g/m², 4.5 mm pile height) | PVC | 3,800 volt | 0 volt |

A similar result is also obtained when using a condensation product of 2 mols of stearic acid N-methylolamide and 1 mol of triethanolamine, quaternised with benzyl chloride.

EXAMPLE 7

500 g of the compound of the formula (59), dissolved in 500 ml of 1:1 ethanol/methyl ethyl ketone mixture, are applied by means of a sponge roller, from a trough, onto a needle-bearing belt of 10 cm width, constructed as an endless belt. 0.6 g of the above solution is applied per cm². The support carries 30 needles per cm², which project 8 mm from their steel fibre fleece bed. The needles treated with the solution are dried with hot air and then introduced into a polyester carpet strip (600 g/m², 4.5 mm pile height) which is also 10 cm wide. The carpet and the needle-bearing belt are drawn slowly between two heating plates heated to 200° C. The residence time of the sandwich of needle-bearing belt and carpet between the heated plates is 5 minutes. The treated polyester carpet pile is oil-repellent. According to the AATCC 118-1966 test method, in which figures of value are assigned to the materials to be tested in order to assess the oil-repellent properties, 1 being the worst and 8 the best figure of value, the pile shows an oil repellency figure of value of 3. The untreated carpet shows a figure of value of 1.

In addition, spilt red wine or fruit juice seeps into the carpet after only about 5 minutes so that ample time remains for removing the staining liquid before it penetrates into the carpet. This produces a marked protection against staining. Untreated carpets or carpets which have only been surface-treated immediately absorb spilt liquid.

EXAMPLE 8

The compound of the formula (78) as 100% strength viscous liquid, is picked up from a trough by means of a dense round brush with soft bristles of 8 mm length and spread onto a needle-bearing belt which passes horizontally over the rotating brush roller. The needle-bearing belt has 25 needles per $cm^2$, which project 8 mm from their steel fibre fleece bed. Excess flameproofing agent is first wiped off by a doctor-like arrangement. The laden needles are stuck into a polyacrylonitrile carpet (550 $g/m^2$, 5 mm pile height). The sandwich of needle-bearing belt and carpet is heated for 5 minutes to 200° C from the side of the needle-bearing belt. Thereafter the needle-bearing belt is removed from the polyacrylonitrile carpet. The carpet treated in this way is tested for flame resistance according to DIN 51,960 in comparison with a carpet which has only been surface-treated, and with an untreated carpet. In the DIN 51,960 test the carpet sample which has been left undried at 70° C is exposed horizontally to an alcohol flame. If 10 specimens of a sample cannot be ignited and, after extinction of the flame, ignition does not continue either with a flame or by smouldering, the sample is to be described as difficult to ignite. If the sample initially ignites under the influence of the alcohol flame but does not burn as far as a sample edge, the maximum burning distance in mm can be measured. The depth of the burn mark, relative to the orginal surface of the sample, can also be measured, in mm, on cross-sections of samples. Whilst the carpet which has only been surface-treated, and the untreated carpet, are easily ignited according to DIN 51,960, the treated carpet no longer burns. According to DIN 51,960, it is difficult to ignite.

In addition, the following burning distances and burn mark depths are found:

| Sample | Burning distance in mm | Burn mark depth in mm |
|---|---|---|
| Carpet treated with the needle-bearing belt, according to the invention | 40 mm | 4 mm |
| Carpet only surface-treated | Burns away completely | Burns away completely |
| Untreated carpet | Burns away completely | Burns away completely |

What we claim is:

1. An apparatus comprising:

a. a longitudinally-movable web-like support, having metal needles mounted on one side thereof perpendicular to the plane of the support;

b. means for applying a heat-transferable organic compound to the needles of the support;

c. means for feeding a textile web into superposed contact with the needles of the support;

d. means for moving the textile web and the needle-bearing support in contact therewith, longitudinally, to pass both through a needle-heating zone and pass the textile web thought a warming zone;

e. means for heating the needles at a temperature high enough to cause the heat transference of the organic compound from the needles to the textile web;

f. means for separating the textile web, bearing the heat-transferred organic compound, from the needle-bearing support; and g. means for warming the textile web at a temperature high enough to fix the heat-transferred organic compound to the textile web.

* * * * *